US006886197B1

(12) United States Patent
Madigan

(10) Patent No.: US 6,886,197 B1
(45) Date of Patent: May 3, 2005

(54) BEDCLOTHES FOR MATTRESS

(75) Inventor: John Michael Madigan, 2636 Lakewood Pl., Westlake Village, CA (US) 91361

(73) Assignee: John Michael Madigan, Westlake Village, CA (US)

( * ) Notice: Subject to any disclaimer, the term of this patent is extended or adjusted under 35 U.S.C. 154(b) by 81 days.

(21) Appl. No.: 10/307,548

(22) Filed: Dec. 2, 2002

(51) Int. Cl.[7] ..... A47G 21/00
(52) U.S. Cl. ..... 5/482; 5/486; 5/493; 5/496
(58) Field of Search ..... 5/482, 486, 493, 5/496, 500

(56) References Cited

U.S. PATENT DOCUMENTS

| | | | | |
|---|---|---|---|---|
| 3,965,504 A | | 6/1976 | Ainsworth | |
| 4,389,744 A | * | 6/1983 | Monroe | 5/498 |
| 4,924,543 A | * | 5/1990 | Hoss et al. | 5/484 |
| 4,979,251 A | | 12/1990 | Lazar | |
| 5,070,561 A | | 12/1991 | Keidser | |
| 5,099,531 A | | 3/1992 | Schmier | |
| 5,208,927 A | | 5/1993 | Lachmar | |
| 5,321,862 A | * | 6/1994 | Campbell | 5/482 |
| 5,367,729 A | | 11/1994 | Lazar et al. | |
| 5,375,274 A | | 12/1994 | Cuneo | |
| 5,638,562 A | * | 6/1997 | Masoncup | 5/493 |
| 5,732,424 A | | 3/1998 | Bond | |
| 5,794,285 A | | 8/1998 | Burch | |
| 6,044,503 A | | 4/2000 | McClendon | |
| 6,061,851 A | | 5/2000 | Crowell | |
| 6,108,836 A | | 8/2000 | Keene, III | |
| 6,122,783 A | | 9/2000 | Herndon et al. | |
| 6,134,730 A | | 10/2000 | Evanson | |

* cited by examiner

*Primary Examiner*—Teri Pham Luu
*Assistant Examiner*—Fredrick Conley

(57) ABSTRACT

This invention relates to an assembly of bedclothes for a mattress for making a bed, and more specifically, to: a mattress cover; a bottom sheet; a top sheet; one or more blankets; a bed assembly covering in the front of a bedspread, comforter or duvet cover; and a dust ruffle; and to a method of assembling and fastening said bedclothes assembly. A second embodiment provides for the top and bottom sheets to be integrated.

8 Claims, 8 Drawing Sheets

BEDCLOTHES FOR MATTRESS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND—FIELD OF INVENTION

This invention relates to an assembly of bedclothes for a mattress for making a bed, and more specifically, to: a mattress cover; a bottom sheet; a top sheet; one or more blankets; a bed assembly covering in the form of a bedspread, comforter or duvet cover; and a dust ruffle; and to a method of assembling and fastening said bedclothes assembly. A second embodiment provides for the top and bottom sheets to be integrated.

BACKGROUND—DESCRIPTION OF PRIOR ART

It has long been known that the changing and arranging of bedclothes is a difficult task for most persons, but most notably for the elderly, the very young and the infirmed or disabled. The need to lift a portion of a mattress to position a fitted sheet corner beneath said mattress or to tuck excess sheeting or blanket material beneath said mattress requires strength and dexterity.

If space is restricted in the vicinity of the mattress, such as in campers or dormitories, even those persons with strength and dexterity can find it difficult to manage the task. Bed frames can interfere with access to the mattress such as in the case of cribs, and some juvenile or hospital beds with restraining sides. The placing of a bed against walls also restricts access to the sides for positioning the bed clothes. In these cases access to all sides can only be accomplished by moving the bed, climbing onto the mattress, lifting the mattress, or reaching over from the unobstructed side. The height associated with the top bunk of a bunk bed often makes access to all sides of a mattress difficult also.

Even when a set of bedclothes has been assembled and arranged at the initial making of the bed with the changing of the sheets, a restless sleeper can easily dislodge sheets and blankets that are tucked in along the sides and bottom edges of the mattress and cause components to slide out of position. This condition requires the realigning of the bedding as well as securing of the bedding in relation to the mattress.

One of the prime issues facing the inventor of a bedding system is whether the sheets (typically a bottom sheet placed underneath the sleeper and a top sheet placed over the sleeper) are separate or integrated. Each solution has its advantages and disadvantages. Separate sheets can be washed, purchased and changed/removed independently of each other, however, the labor involved in removing and installing the sheets is double. Integrated sheets are easy to install and remove as a unit, but make for a large laundry load because of the bulk. Integrated sheets must be purchased together and bottom sheets, which typically wear out first, can not be replaced economically. Additionally, integrated sheets require additional sewing in the manufacturing process. With these issues in mind, this bedclothes system has been designed to accommodate either solution.

Various attempts have been made to address the disadvantages and problems associated with conventional bedclothes designs. Several inventions, including U.S. Pat. No. 6,061,851 to Crowell, propose an assembly where the top and bottom sheets are permanently connected to each other, usually by sewing. Crowell also proposes the fixed attachment of the top and bottom sheets along one side, as well as the bottom edge, which may be confining and restrictive to a sleeper.

U.S. Pat. No. 6,044,503 to McClendon also proposes the permanent attachment of various parts of a bedding assembly to other parts which forces the use of bedding components that may not be desirable, namely, a dust ruffle.

Solutions such as those proposed by Crowell, McClendon, and others, are also restrictive in regard to the ability to vary colors and patterns at will within a decorative scheme.

U.S. Pat. No. 6,134,730 to Evanson proposes a bedding system that deals only with bedding that is positioned on top of the sleeper and thus ignores problems associated with attaching a bottom sheet. Since the bottom sheet must be affixed at all four sides and corners of the mattress, it is one of the more difficult items of bed clothing to change and install and should be addressed in a comprehensive bed clothes assembly.

U.S. Pat. No. 6,108,836 to Keene, III proposes integrated top and bottom sheets. The bottom sheet employs two long pockets which are difficult to install on the mattress. The construction of said pockets require complicated sewing in the manufacturing.

U.S. Pat. No. 5,099,531 to Schmier proposes a bedding system in which sheets and blankets can be attached separately, however the system requires modifications to the mattress in the form of attaching buttons which would require expensive retrofitting of existing mattresses or the attachment of buttons during the mattress manufacturing process.

BACKGROUND OF INVENTION—OBJECTS AND ADVANTAGES

Given the problems inherent in the previous inventions and the need for a bedding system that can be used by the disabled without great expense, an object of the present invention is to provide a bed clothes system that is easily aligned and installed, and removed by those persons with limited strength or flexibility.

Another object is to provide a bed clothes system that is not substantially hindered by placing the mattress in an area of limited accessibility.

Another object is to provide a bed clothes system in which the individual components are independent of each other, allowing one component to be removed, installed, or not included at the will of the user. This feature allows for cleaning and replacing individual components without removing or replacing multiple components. As various parts of the system wear out and need to be replaced, individual replacement components can be purchased and integrated into the system in an economical manner. This feature also allows individual components to be easily changed to match decor without requiring the purchase of a complete new system.

Another object is to provide a bed clothes system that is easily manufactured, without complicated pockets, panels or flaps and that will be accepted by any conventional mattress.

Another object is to minimize the process of lifting the mattress, and pushing and/or tucking material between the components of the bed (e.g., mattress and box spring; mattress and spring; mattress and bed frame), in order to make the bed making and changing process easier.

Another object is to provide for decorative coordination of fabric, color, style, and pattern in a bedclothes system. As a coordinated system of attachment and placement, coordination for decorative purposes can be easily achieved in the manufacturing process.

The design of this invention does not preclude the user adding conventional bedding items as needed. Some find the need to add waterproof pads or extra mattress padding and the design of this invention, while it does not include such items, it does not make it difficult or inconvenient to add such items as needed.

These and other more detailed and specific objects of the present invention will be better understood by reference to the following figures and detailed description which illustrate by way of example a few of the various forms of the invention within the scope of the appended claims.

SUMMARY OF THE INVENTION

Briefly, the present invention proposes an integrated system of changeable parts of a bedclothes system that addresses the difficulty of changing various parts of the bedclothes, keeping the assembly components aligned and independent all in an economical and practical manner that allows each component to be removed or changed separately without disturbing other components.

The main feature of the bedclothes system is that it incorporates attachment points on the exposed head, sides and foot of the base mattress covering to which all other components are attached. This eliminates any further steps when attaching and removing components, eliminates lifting of the mattress, and eliminates the need to place portions of the other components beneath the mattress in order to secure their placement. It facilitates the adding and removing of components and increases the ease with which these tasks can be performed in areas of limited access and by persons with physical limitations. This feature also aids in keeping bedclothes aligned and positioned properly on the bed.

The bedclothes system is comprised of a base covering for the mattress which provides for the attachment of the various components, including a bottom sheet, a top sheet, a bed skirt or dust ruffle, one or more blankets, and a top covering, such as a bedspread, comforter, or duvet cover. When marketed as an integrated system, pillow case(s) would also be included, although they are not a stated part of this invention. A secondary embodiment incorporates an integrated assembly of a bottom and top sheet. Attachment of the components to the base covering can be provided by use of buttons and buttonholes, snaps, loop and hook attachments (Velcro©), hooks and eyes, zippers or other attachment system. All components may be customized to the dimensions of the mattress to be covered, for example, twin, full, queen, king, youth, long, cot, air mattress or crib. No alteration or retrofitting of the mattress is needed.

It is to be understood that both the foregoing general description and the following detailed description are exemplary and explanatory only and are not restrictive of the invention claimed.

BRIEF DESCRIPTION OF THE DRAWINGS

The accompanying drawings, which are incorporated in and constitute a part of the specification, illustrate a primary and a secondary embodiment of the invention and together with the general description, serve to explain the principles of the invention.

DETAILED DESCRIPTION

Figure 1:
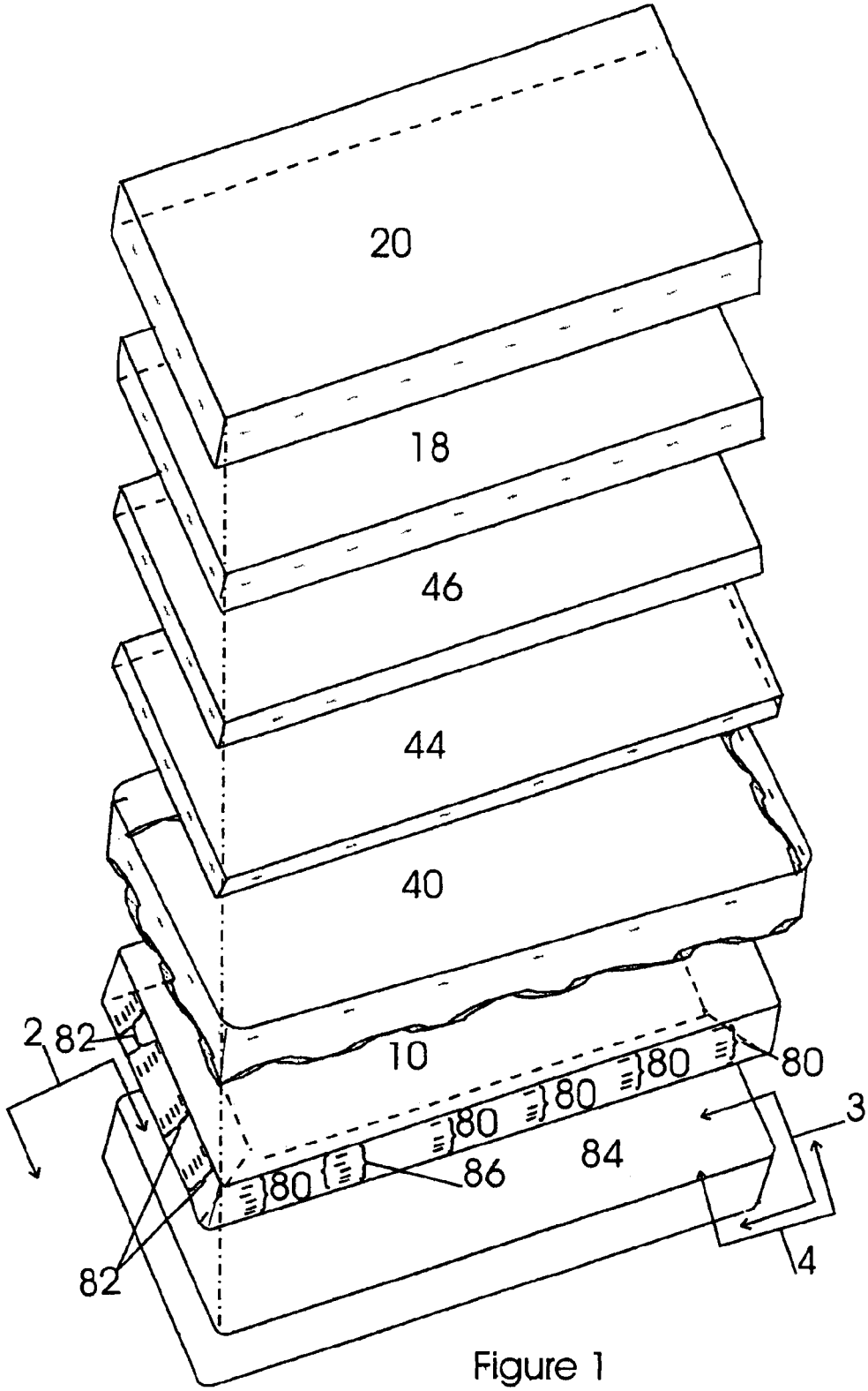
FIG. 1 is an exploded perspective view of the invention in the primary embodiment showing the mattress, mattress cover, bed ruffle or bed skirt, bottom sheet, top sheet, blanket, and outer covering in the form of a bed spread, comforter or duvet cover.

Refer now to the figures and particularly to FIG. 1 which illustrates the primary embodiment of the bedding system consisting of a conventional mattress 84 over which is placed a mattress cover 10 to which is attached a bed skirt or dust ruffle 40, a bottom sheet 44, a top sheet 46, a blanket 18, and a top covering 20 such as a bed spread, comforter, or duvet cover.

Shown on the mattress cover 10 are five rows of attachment points 80 along the outer vertical side covering surface 88 of the cover and attachment points 82 at the outer vertical foot covering surface 90 of the mattress cover. Present, but not shown, are duplicate attachment points along the far, hidden outer side covering surface and two rows of attachment points along the outer vertical head covering surface 52 of the mattress cover. For the purpose of illustration the attachment points on all the figures are shown as hook and loop fasteners (Velcro™), but buttons and buttonholes, snaps, hooks and eyes, zippers or any other conventional attachment method can be used. The mattress cover is designed to cover the horizontal top, vertical sides, vertical head, vertical foot, and part of the horizontal underside of the mattress. Coverage of the undersides 38 and 48 is dependent on the design of the mattress cover and the type of method used to secure it to the mattress. Typically this function is performed by deep pockets at the head and foot ends, triangulated pockets at each corner, elasticized edges or sections, straps or other methods.

For the primary embodiment, employing separate bottom 44 and top 46 sheets, both outer vertical sides 88 of the mattress cover have four full and one partial row of attachments, the outer vertical foot 90 has five full rows of attachments and the outer vertical head 52 has two full rows of attachments.

The bottom sheet 44 is provided with full rows of attachment points 72, 64, and 66 along all four edges of its underside that correspond to the top row of attachment points 16, 30 and 50 on each of the four sides of the mattress cover. These allow the bottom sheet to be easily aligned and attached without excessive bending and without lifting of the mattress.

The top sheet 46 is provided with a full row of attachment points 76 along the underside of its foot covering edge and partial rows 74 along the two side covering edges which correspond to the second row of attachment points 28 on the foot 90 of the mattress cover and the partial row of attachment points, i.e., the second row, on the sides 88 of the mattress cover. The attachment points along the side edges extend in a partial row from near the bottom edge of the sheet to a point approximately aligned with point 86. Attaching the top sheet along only part of the side edge allows the sleeper to easily enter and leave the bed without impediment and to move while lying in the bed without confinement. This arrangement also minimizes the chances of dislodging elements of the bedding assembly during restless sleep.

The blanket is provided with full rows of attachment points along the underside of the foot and both sides. The blanket employs the middle or third row 22 and 60 of attachment points on the foot and both sides covering surfaces of the mattress cover. When the bed is in use, the sides of the blanket can be separated from side 88 of the mattress cover to allow easy entering and leaving of the bed, and to allow movement while sleeping without confinement. Since the top sheet 46 does not have attachment points along part of the underside of the side and hangs free, the sleeper is protected by the top sheet from coming into contact with the attachment points that are separated on the underside of the blanket. The full row of side attachment points on the underside of the blanket can be employed to present a neat and aligned appearance when the bed is made.

The top covering 20, typically a bed spread, comforter, or duvet cover, employs the fourth row of attachment points 24 and 62 along the foot and both sides covering surfaces of the mattress cover. Attachment is via full rows of attachment points along the underside of the foot and both sides of the top covering. It, too, can be detached either partially or fully to allow getting into and out of the bed and for removal, if desired, when the bed is in use.

The bottom row 78, 26, and 68 of attachment points at the head, foot and both sides covering surfaces of the mattress cover are employed by the dust ruffle/bed skirt 40. This element does not cover the top horizontal plane of the mattress cover as do the other elements, but instead hangs vertically from the four sides to hide the box spring 42, bed frame, under-bed storage or other unsightly items. The dust ruffle employs a row of attachment points on the inside of its upper edge to attach to the lower row of attachment points on the two sides, the head and the foot of the mattress cover.

Figure 2:
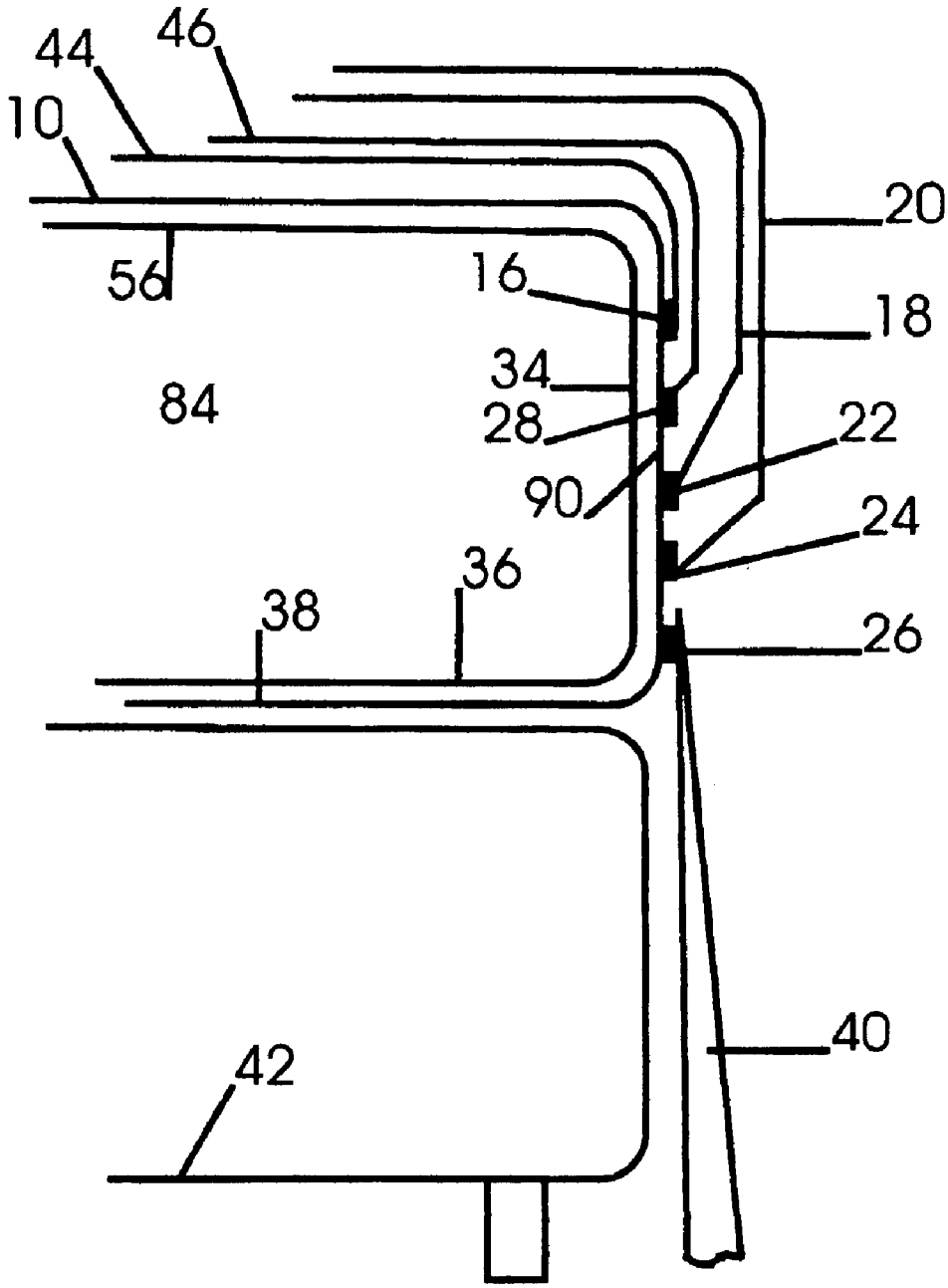
FIG. 2 is a sectional view of the invention taken at line 2 in FIG. 1 showing the foot of the bed in the primary embodiment with a separate bottom sheet and a separate top sheet.
Figure 2A:
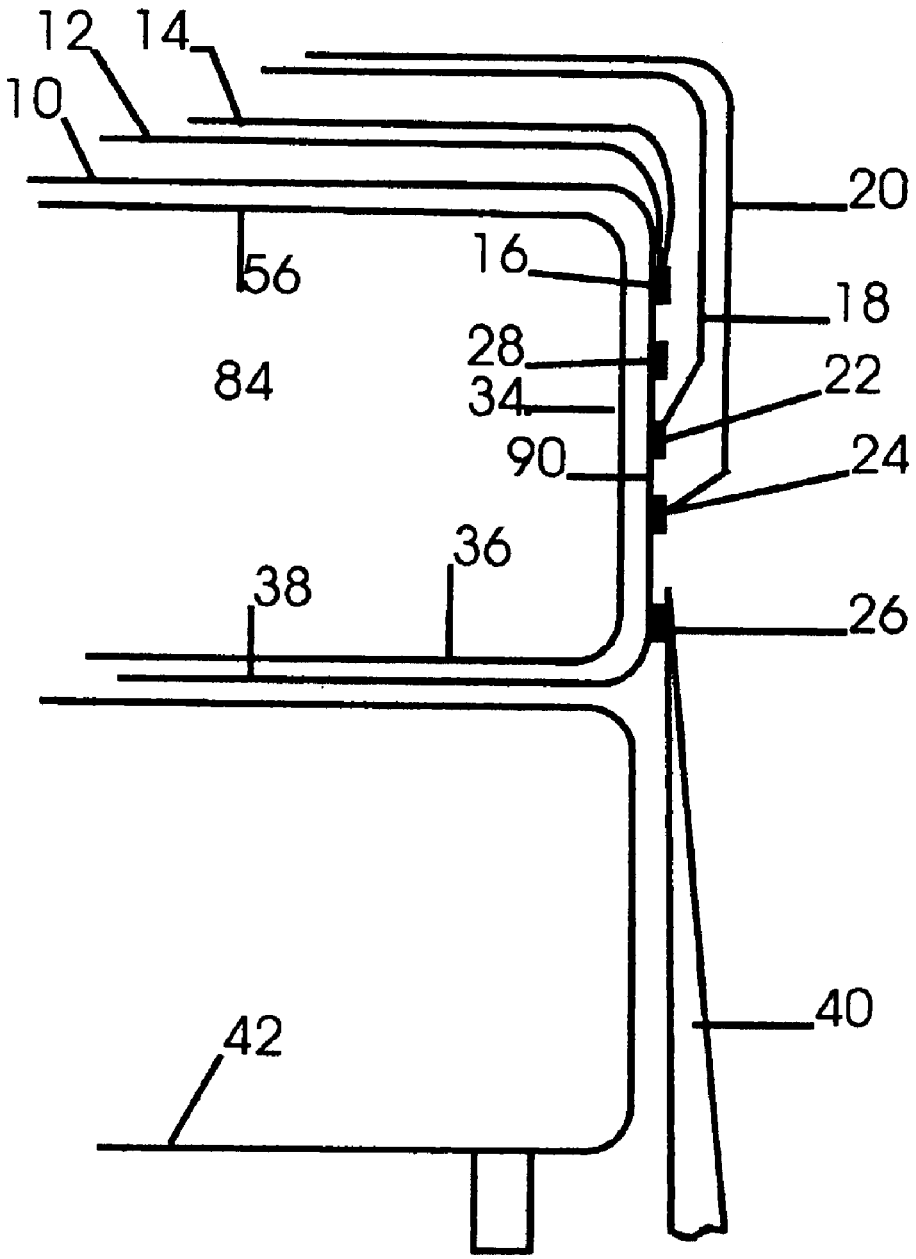
FIG. 2A is a sectional view of the invention showing the foot of the bed in the secondary embodiment with integrated bottom and top sheets.

FIGS. 2 and 2A show a sectional view of the bedding system along the foot of the bed as viewed from the side. Mattress 84 is covered by mattress cover 10 along the top 56, foot 34, and partially along the bottom 36. In FIG. 2, the primary embodiment, bottom sheet 44 is attached at the top row 16 of attachment points, top sheet 46 is attached at the second row 28 of attachment points, blanket 18 is attached at the third row 22 of attachment points, top covering 20 is attached at the fourth row 24 of attachment points, and the dust ruffle 40 is attached at the lower or fifth row 26 of attachment points. In FIG. 2A, the secondary embodiment which employs an integrated top 12 and bottom 14 sheet, both sheets are attached at the first row 16 of attachment points. The second row of attachment points 28 is left unused unless an additional blanket 18 utilizes the row.

Figure 3:
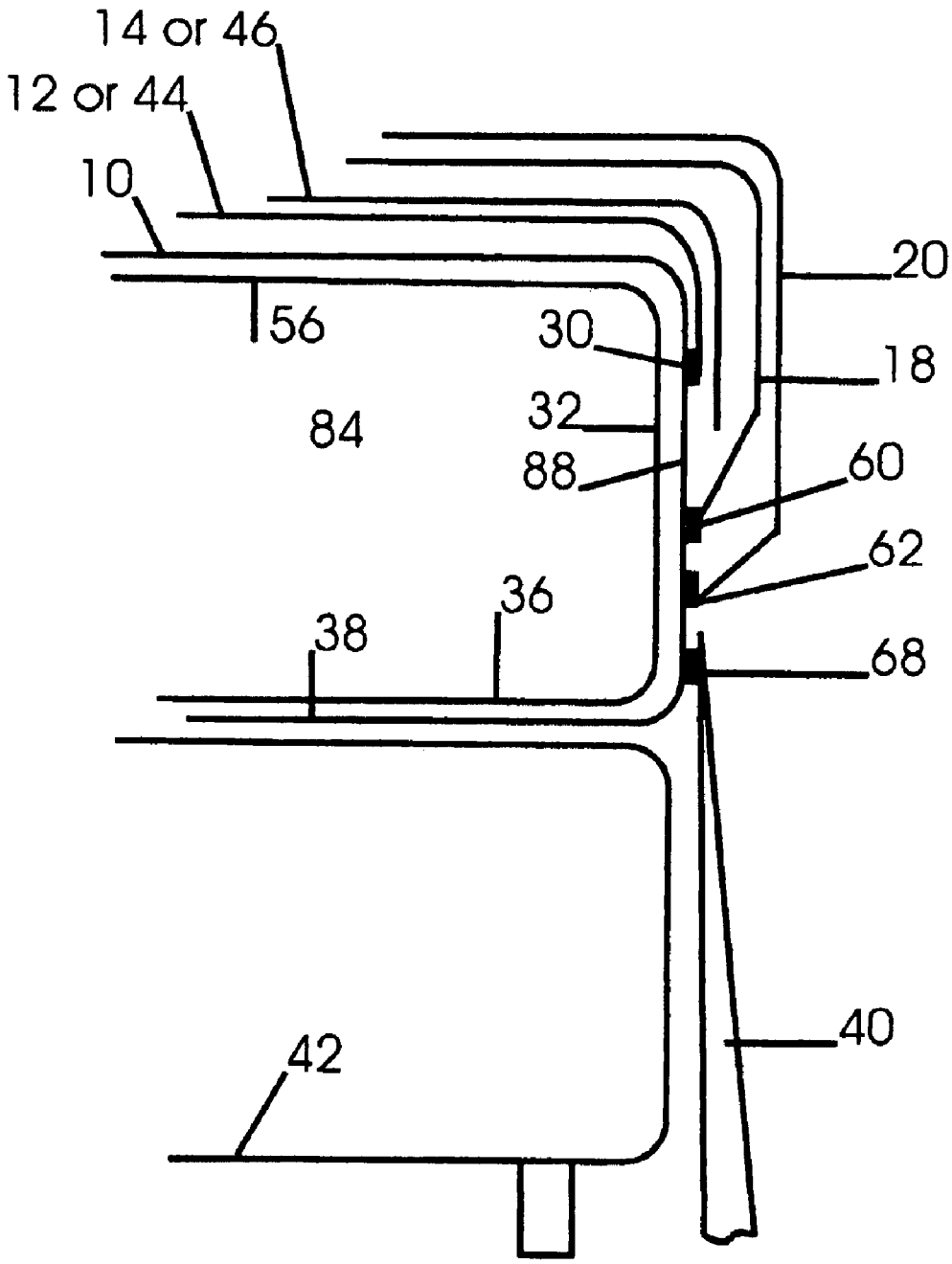
FIG. 3 is a sectional view of the side of the bed taken at line 3 from the head of the bed. This view is the same for either embodiment.

FIG. 3 shows a sectional view of the bedding system along the side 32 of the mattress as viewed from the mattress. Mattress 84 is covered by mattress cover 10 along the top 56, side 32 and partially along the bottom 36. FIG. 3 applies to both the primary and secondary embodiments. Bottom sheet 12 or 44 attaches at the top row of attachment points 30. Top sheet 14 or 46 hangs free since sheet 46 would only be attached further toward the foot of the side and top sheet 14 would have no side attachments due to its integration with the bottom sheet 12.

Blanket 18 attaches to the third or middle row 60 of attachment points. The top covering 20 is attached at the fourth row 62 of attachment points, and the dust ruffle 40 is attached at the lower or fifth row 68 of attachment points.

Figure 4:
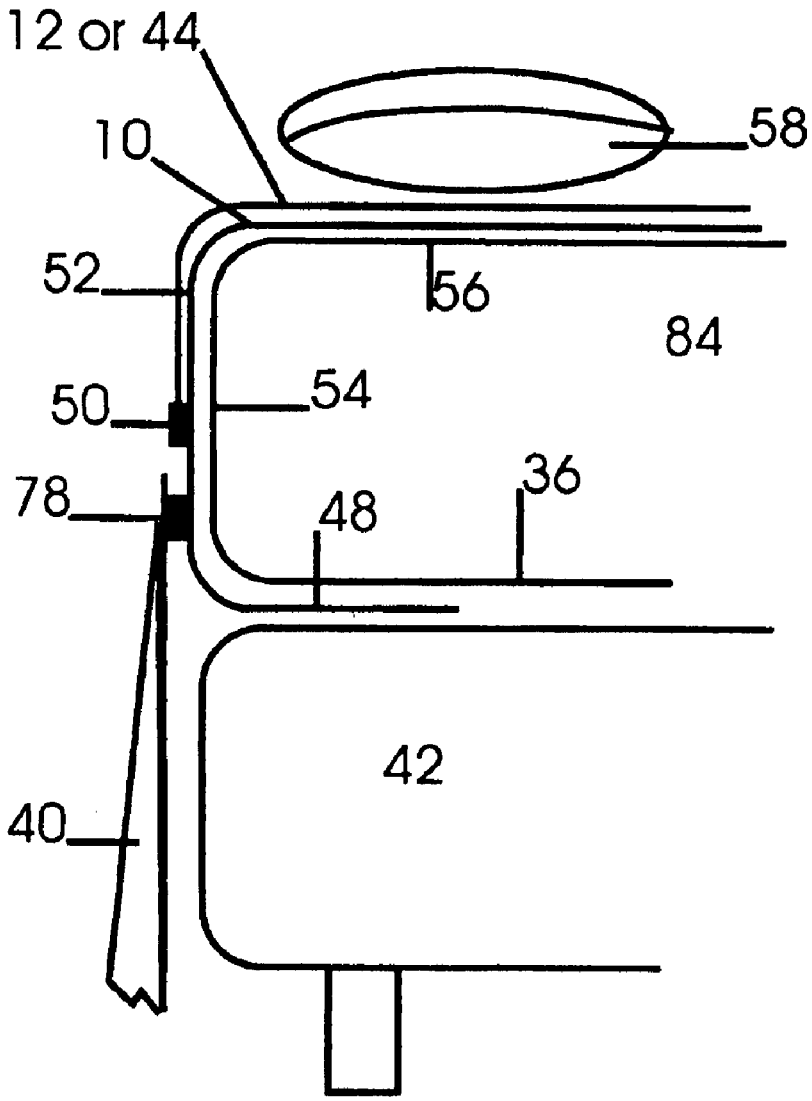
FIG. 4 is a sectional view of the head of the bed at line 4 as seen from the side of the bed.

FIG. 4, a sectional view of the head of the bed as viewed from the side, shows the mattress cover 10 covering the mattress 84 along the top 56, head 54, and partially along the bottom 36. FIG. 4 applies to both the primary and secondary embodiments. Bottom sheet 12 or 44 attaches at the top row of attachment points 50. Dust ruffle 40 is attached at the lower or second row 78 of attachment points. A pillow case, employing matching or coordinating fabric, covers pillow 58.

Figure 5:
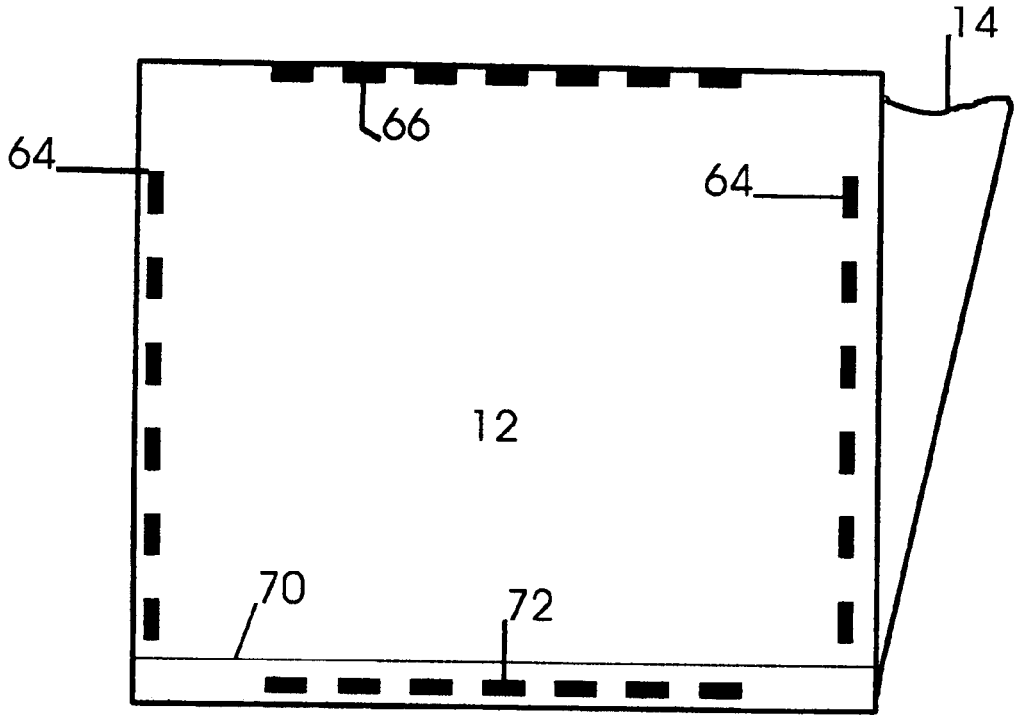
FIG. 5 is a view of the sheet assembly for the secondary embodiment as seen from the underside.

FIG. 5 is a view of the integrated sheet assembly for the secondary embodiment as viewed from the bottom or underside. Rows of attachment points 64, 66 and 72 run along the sides, head and foot, respectively, of the bottom sheet 12 of the assembly which attach the sheet to the attachment points 30, 50, and 16 respectively located on the mattress cover 10. Top sheet 14 hangs free with no connection to any attachment points since it is attached via its union with bottom sheet 12 at stitching 70.

Figure 6:
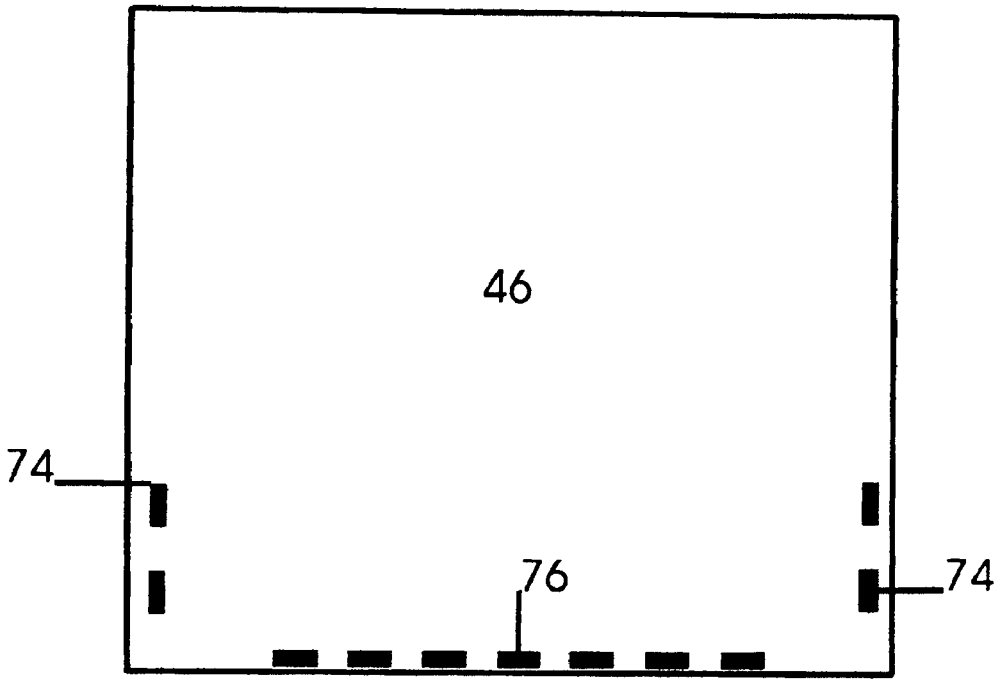
FIG. 6 is a view of the top sheet for the primary embodiment as seen from the underside.

FIG. 6 is a view of the top sheet 46 for the primary embodiment as seen from the underside. Full rows of attachment points 76 and partial rows 74 run along the foot and sides, respectively, of the top sheet 46 which attach the sheet to the attachment points 28 and the partial second row attachment points located on the mattress cover 10.

Figure 7:
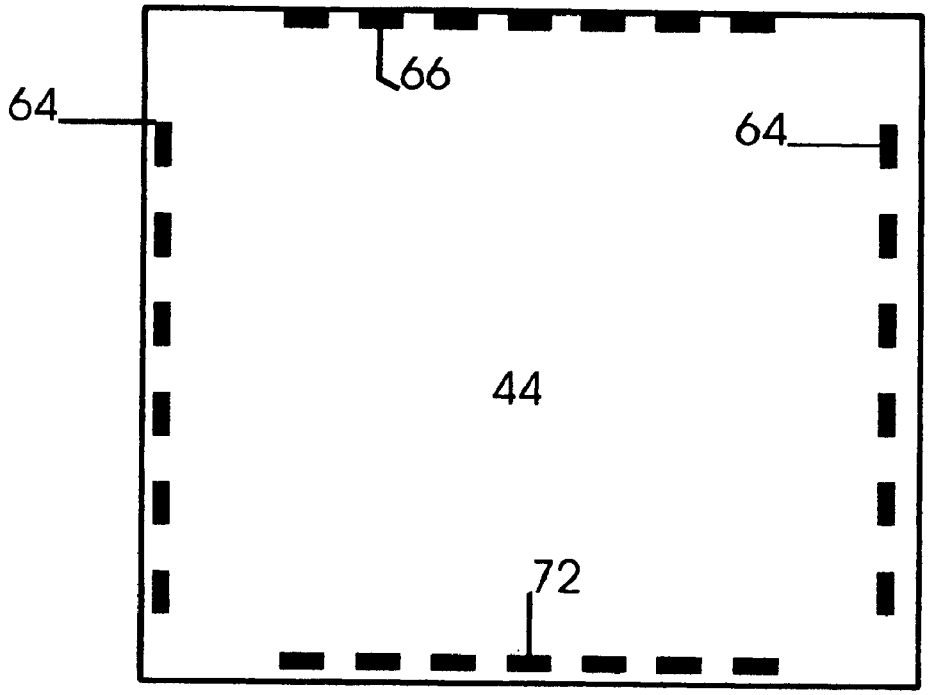
FIG. 7 is a view of the bottom sheet for the primary embodiment as seen from the underside.

FIG. 7 is a view of the bottom sheet 44 for the primary embodiment as seen from the underside. Rows of attachment points 64, 66 and 72 run along the sides, head and foot, respectively, of the sheet which attach the sheet to the attachment points 30, 50, and 16 respectively located on the mattress cover 10.

In view of the above description of a preferred embodiment and modifications thereof, various other modifications will now become apparent to those skilled in the art.

What is claimed is:

1. A bedclothes system for covering a mattress with said mattress having an upper surface, opposed left and right side surfaces, opposed head and foot end surfaces, and a lower surface, said bedclothes comprising:

a) a mattress cover having an outer surface and an inner surface configured for covering said top, sides, head, foot, and partial bottom surfaces of said mattress;

b) a multiplicity of rows of fastening means spaced apart laterally on said outer surface of said sides, head and foot covering surfaces of said mattress cover as complimentary fastening means;

c) a bottom sheet having an upper surface and an under surface configured for covering said top, and partial head, foot, and side covering surfaces of said mattress cover;

d) a row of fastening means spaced apart laterally on the under portion of said partial side, head and foot covering surfaces of said bottom sheet as complimentary fastenings for mating with one said row of corresponding complimentary fastening means of said mattress cover;

e) a top sheet having an upper surface and an under surface configured for covering said top, sides and foot covering surfaces of said bottom sheet;

f) a row of fastening means spaced apart laterally on the under portion of said sides and foot covering surface of said top sheet as complimentary fastenings for mating with one said row of corresponding complimentary fastening means of said mattress cover;

g) a blanket covering having an upper surface and an under surface configured for covering said top, sides and foot covering surfaces of said top sheet;

h) a row of fastening means spaced apart laterally on the under portion of said sides and foot covering surface of said blanket covering as complimentary fastenings for mating with one said row of corresponding complimentary fastening means of said mattress cover;

i) a top bed spread covering with an upper surface and an under surface configured for covering said top, sides and foot covering surfaces of said-blanket covering;

j) a row of fastening means spaced apart laterally on the under portion of said sides and foot covering surfaces of said bedspread covering as complimentary fastenings for mating with one said row of corresponding complimentary fastening means of said mattress cover;

k) a dust ruffle having an outer surface and an inner surface configured for partially covering said head, sides and foot covering surfaces of said mattress cover and extending below the bottom edge of said mattress;

l) a row of fastening means spaced apart laterally on the inner top edge of said sides, head and foot covering surface of said dust ruffle as complimentary fastenings for mating with one said row of corresponding complimentary fastening means of said mattress cover.

2. The bedclothes system of claim 1 where said complimentary fastening means and said corresponding complimentary fastening means consists of hook and loop fasteners (Velcro™), buttons and buttonholes, hooks and eyes, snaps, zippers, or other recognized complementary fastening system.

3. The bedclothes system of claim 1 where said blanket covering is a blanket, electric blanket, comforter, quilt, duvet covering, afghan, quilt or other blanket-like covering.

4. The bedclothes system of claim 1 where said bedspread covering is a bedspread, comforter, quilt or other bedspread-like covering.

5. A bedclothes system for covering a mattress with said mattress having an upper surface, opposed left and right side surfaces, opposed head and foot end surfaces, and a lower surface, said bedclothes comprising:

a) a mattress cover having an outer surface and an inner surface configured for covering said top, sides, head, foot, and partial bottom surfaces of said mattress;

b) a multiplicity of rows of fastening means spaced apart laterally on said outer surface of said sides, head and foot covering surfaces of said mattress cover as complimentary fastening means;

c) a bottom sheet having an upper surface, an under surface and an attached top sheet with said bottom sheet configured for covering said top, and partial head, foot, and side covering surfaces of said mattress cover;

d) a row of fastening means spaced apart laterally on the under portion of said partial side, head and foot covering surfaces of said bottom sheet with attached top sheet as complimentary fastenings for mating with one said row of corresponding complimentary fastening means of said mattress cover;

e) a blanket covering having an upper surface and an under surface configured for covering said top, sides and foot covering surfaces of said bottom sheet with attached top sheet;

f) a row of fastening means spaced apart laterally on the under portion of said sides and foot covering surface of said blanket covering as complimentary fastenings for mating with one said row of corresponding complimentary fastening means of said mattress cover;

g) a top bedspread covering with an upper surface and an under surface configured for covering said top, sides and foot covering surfaces of said blanket covering;

h) a row of fastening means spaced apart laterally on the under portion of said sides and foot covering surfaces of said bedspread covering as complimentary fastenings for mating with one said row of corresponding complimentary fastening means of said mattress cover;

i) a dust ruffle having an outer surface and an inner surface configured for partially covering said head, sides and foot covering surfaces of said mattress cover and extending below the bottom edge of said mattress;

j) a row of fastening means spaced apart laterally on the inner top edge of said sides, head and foot covering surface of said dust ruffle as complimentary fastenings for mating with one said row of corresponding complimentary fastening means of said mattress cover.

6. The bedclothes system of claim 5 where said complimentary fastening means and said complimentary corresponding fastening means consists of hook and loop fasteners (Velcro™), buttons and buttonholes, hooks and eyes, snaps, zippers, or other recognized complementary fastening system.

7. The bedclothes system of claim 5 where said blanket covering is a blanket, electric blanket, comforter, quilt, duvet covering, afghan or other blanket-like covering.

8. The bedclothes system of claim 5 where said bedspread covering is a bedspread, comforter, quilt or other bedspread-like covering.

* * * * *